United States Patent [19]

Tomlinson

[11] Patent Number: 4,577,615

[45] Date of Patent: Mar. 25, 1986

[54] HEAT PIPE CENTRAL FURNACE

[75] Inventor: Ronald S. Tomlinson, Antioch Township, Davidson County, Tenn.

[73] Assignee: Heil-Quaker Corporation, Lewisburg, Tenn.

[21] Appl. No.: 685,711

[22] Filed: Dec. 24, 1984

[51] Int. Cl.[4] ..... F24H 3/00

[52] U.S. Cl. ..... 126/99 A; 126/116 R; 122/44 A

[58] Field of Search ..... 126/99 A, 99 R, 99 D, 126/108, 109, 116 R, 110 R; 110/336, 337; 237/55; 122/44 A, 44 B, 44 R, 75, 367 R, 367 A, 367 C; 165/134, 135, 104.19, 104.21; 181/249, 258, 264, 270

[56] References Cited

U.S. PATENT DOCUMENTS

| | | | |
|---|---|---|---|
| 1,174,533 | 3/1916 | Townsend | 122/44 A |
| 1,725,906 | 8/1929 | Gay . | |
| 2,237,054 | 4/1941 | Jensen | 126/101 |
| 2,533,508 | 12/1950 | Riu | 126/101 |
| 3,232,591 | 2/1966 | Wiley, Jr. | 263/33 |
| 3,470,864 | 10/1969 | Emmert | 126/110 |
| 3,774,374 | 11/1973 | Dufour et al. | 126/99 |
| 3,935,855 | 2/1976 | van Vliet | 126/110 R |
| 3,941,311 | 3/1976 | McNeely | 237/16 |
| 4,177,858 | 12/1979 | Daman et al. | 165/11 |
| 4,275,705 | 6/1981 | Schaus et al. . | |
| 4,280,554 | 7/1981 | Stockman | 165/11 R |
| 4,316,435 | 2/1982 | Nagamatsu et al. | 122/235 F |

OTHER PUBLICATIONS

"The Heat-Pipe Furnace"-Tom Blandy and Rex Clark in Mechanics Illustrated, Nov. 1983.

"Borg-Warner HeatPipe Furnace"-Borg-Warner Corp. 1983.

Terhmacore, Inc. Nov. 1979 literature.

*Primary Examiner*—Larry Jones

*Attorney, Agent, or Firm*—Wood, Dalton, Phillips, Mason & Rowe

[57] ABSTRACT

A heat pipe heat transfer structure for use in a furnace wherein individual heat pipes are arranged in a series for successive heat transfer association with the hot products of combustion of the furnace. The heat transfer enclosure defines successively a combustion chamber portion, an acoustic decoupling portion, and an input heat transfer chamber portion. The heat transfer chamber portion, in turn, is divided into first and second portions. The first portion of the input heat transfer chamber portion, in the illustrated embodiment, decreases in cross sectional area in a direction away from the burner. The final portion of the input heat transfer chamber portion, in the illustrated embodiment, has a constant cross sectional area. The heat pipes are arranged in a folded series row, with the direction of the products of combustion being reversed in entering the first portion from the combustion chamber and in passing from the first portion to the second portion before being discharged to the vent pipe of the furnace. The construction provides improved uniform loading of the heat pipes and acoustic decoupling of the burner from the input heat transfer chamber portion.

24 Claims, 10 Drawing Figures

FIG. 1
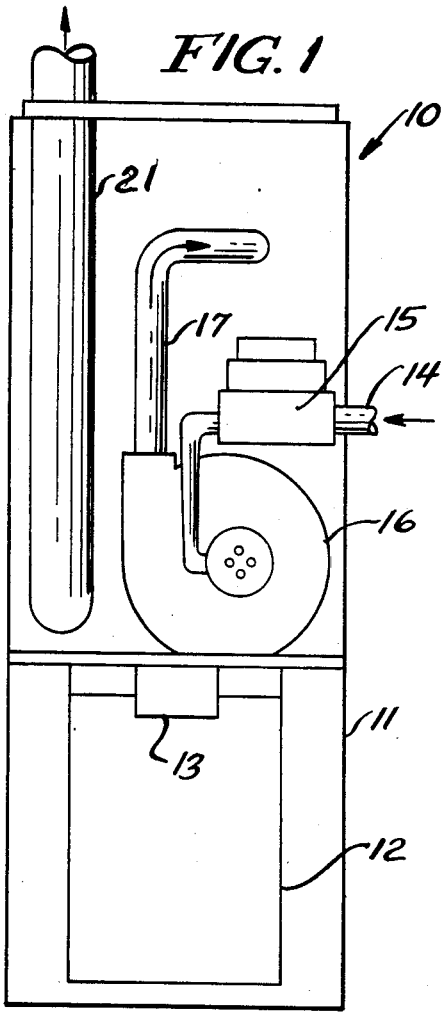
FIG. 2
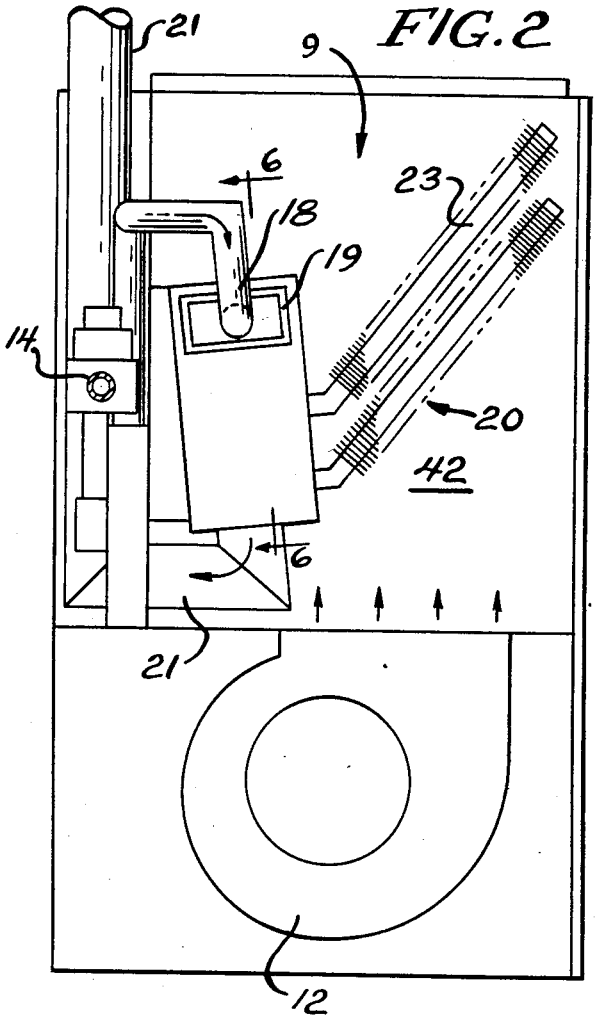
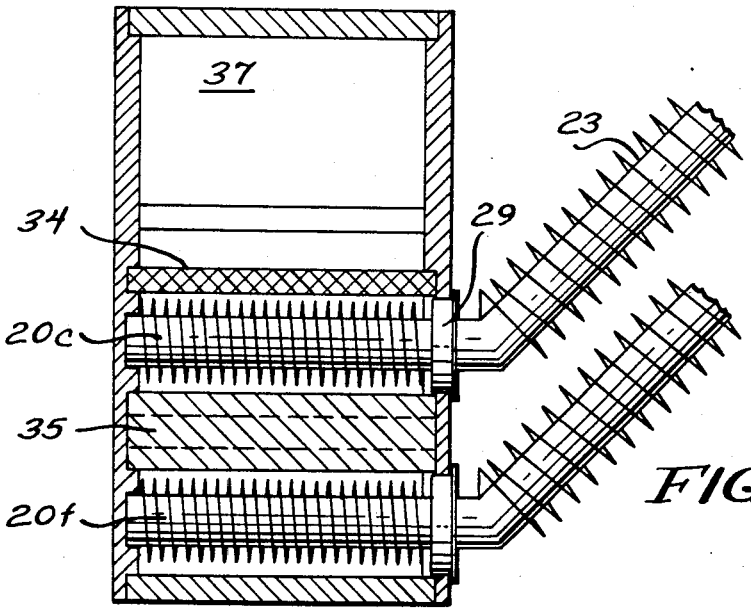
FIG. 7

HEAT PIPE CENTRAL FURNACE

BACKGROUND OF THE INVENTION

1. Field of the Invention

This invention relates to furnaces and, in particular to heat pipe furnaces.

2. Description of the Background Art

In transferring heat from the heat source in conventional furnaces, a substantial variety of different heat transfer means have been employed in an effort to obtain improved efficiency and economy. One such heat transfer means comprises a plurality of heat pipes which are heated at one end by the heat source and which transfer heat from the opposite end to the medium being heated. Conventionally, such heat pipes comprise sealed tubes containing a vaporizable fluid which is condensed upon release of heat therefrom to the medium being heated so as to return by gravity to the lower end heated by the heat source for revaporization and a continued circulation of the fluid in this manner in the heat pipe. As the fluid provides a high heat transfer rate, improved efficiency in heat transfer in such furnaces is obtained.

It is conventional to utilize a plurality of individual heat pipes cumulatively providing the total desired heat transfer effect. The present invention is concerned with an improved arrangement of such a plurality of heat pipes in providing an improved furnace structure.

SUMMARY OF THE INVENTION

More specifically, the invention comprehends the provision of an improved furnace structure having an input heat source means, means defining a heat exchange chamber having heat input and heat output portions, and means for conducting a fluid to be heated through the heat exchange output portion of the heat exchange chamber for transfer of heat to the fluid. A plurality of heat pipes, each having an evaporator portion and a condensing portion and a condensable heat transfer fluid therein, are provided to serially receive heat from the input source in conjunction with means for uniformly loading a plurality of the heat pipes in the furnace as an incident of transferring heat from the input heat source means through the evaporator portion and condenser portion of each heat pipe to the fluid to be heated in the heat exchange chamber.

The furnace further defines a combustion chamber for conducting hot combustion products to the heat input portion of the heat transfer chamber.

In the illustrated embodiment, the heat pipes are arranged to be heated by the heat source means to different temperatures.

In the illustrated embodiment, the heat pipes are arranged in discrete groups, the loading means causing heat transfer through only one of the groups substantially below the maximum rate at which the heat pipes thereof are designed to operate.

In the illustrated embodiment, a first number of the heat pipes are designed to be operated at substantially the same maximum heat transfer rate, illustratively 14,000 BTU's per hour.

In the illustrated embodiment, the heat pipes are spaced in a series extending in the direction of flow of fluid from the combustion chamber through an input heat transfer chamber.

In the illustrated embodiment, the heat input portion of the heat transfer chamber includes a first portion having a transverse cross section which decreases in area in a direction away from the input heat source means.

In the illustrated embodiment, the heat transfer chamber includes a final portion having a transverse cross section which is constant in area in a direction away from the input heat source means.

In the illustrated embodiment, the input portion of the heat transfer chamber defines a flow path having an outlet for conducting hot fluid provided from the input heat source means to the outlet and means for disposing the evaporator portion of the heat pipes in a series extending longitudinally of the flow path for successive heat transfer association thereof with the fluid heated by the heat source. The condensing portions thereof are disposed in the output heat exchange chamber for transferring heat from the condensable heat transfer fluid in the heat pipes to the fluid to be heated.

In the illustrated embodiment, the flow path of the hot fluid provided from the input heat source defines portions having different flow restricting characteristics and the heat pipe evaporator portions are arranged in successive groups along the path corresponding to the different restrictive portions. At least one of the flow path portions in the illustrated embodiment defines a variable flow restricting characteristic longitudinally thereof.

In the illustrated embodiment, the variable flow restricting characteristic comprises an increasing of the flow restriction away from the heat source.

In the illustrated embodiment, the groups of heat pipes define a folded series.

The downstreammost pipe evaporator portion may be disposed adjacent the flow path outlet.

The invention further comprehends the provision, in a furnace having burner means for producing hot products of combustion, and a heat exchanger means defining a flow chamber for conducting the hot products of combustion for heat transfer association with heatable output means, of acoustic decoupling means for preventing resonating of the products of combustion in the flow chamber.

In the illustrated embodiment, the heat exchanger means includes a row of heat exchanger tubes and the acoustic decoupling means comprises means for disposing the burner means in disalignment with the row.

In the illustrated embodiment, the invention comprehends the provision of a transfer passage between the combustion chamber and the flow chamber opening substantially perpendicularly to the flow chamber at one end of the row of heat exchanger tubes.

In the illustrated embodiment, the burner means is disposed in the combustion chamber remotely from the transfer passage, with the direction from the burner means to the transfer passage being substantially opposite the direction flow of the products of combustion from the transfer passage through the flow chamber.

The improved furnace construction of the present invention is extremely simple and economical of construction while yet providing improved efficiency and economy in the operation of the furnace.

BRIEF DESCRIPTION OF THE DRAWING

Other features and advantages of the invention will be apparent from the following description taken in connection with the accompanying drawing wherein:

FIG. 1 is a front elevation of a furnace having heat transfer means embodying the invention;

FIG. 2 is a side elevation thereof;

FIG. 7 is a vertical section taken substantially along the line 7—7 of FIG. 6;

DESCRIPTION OF THE PREFERRED EMBODIMENT

Figure 3:
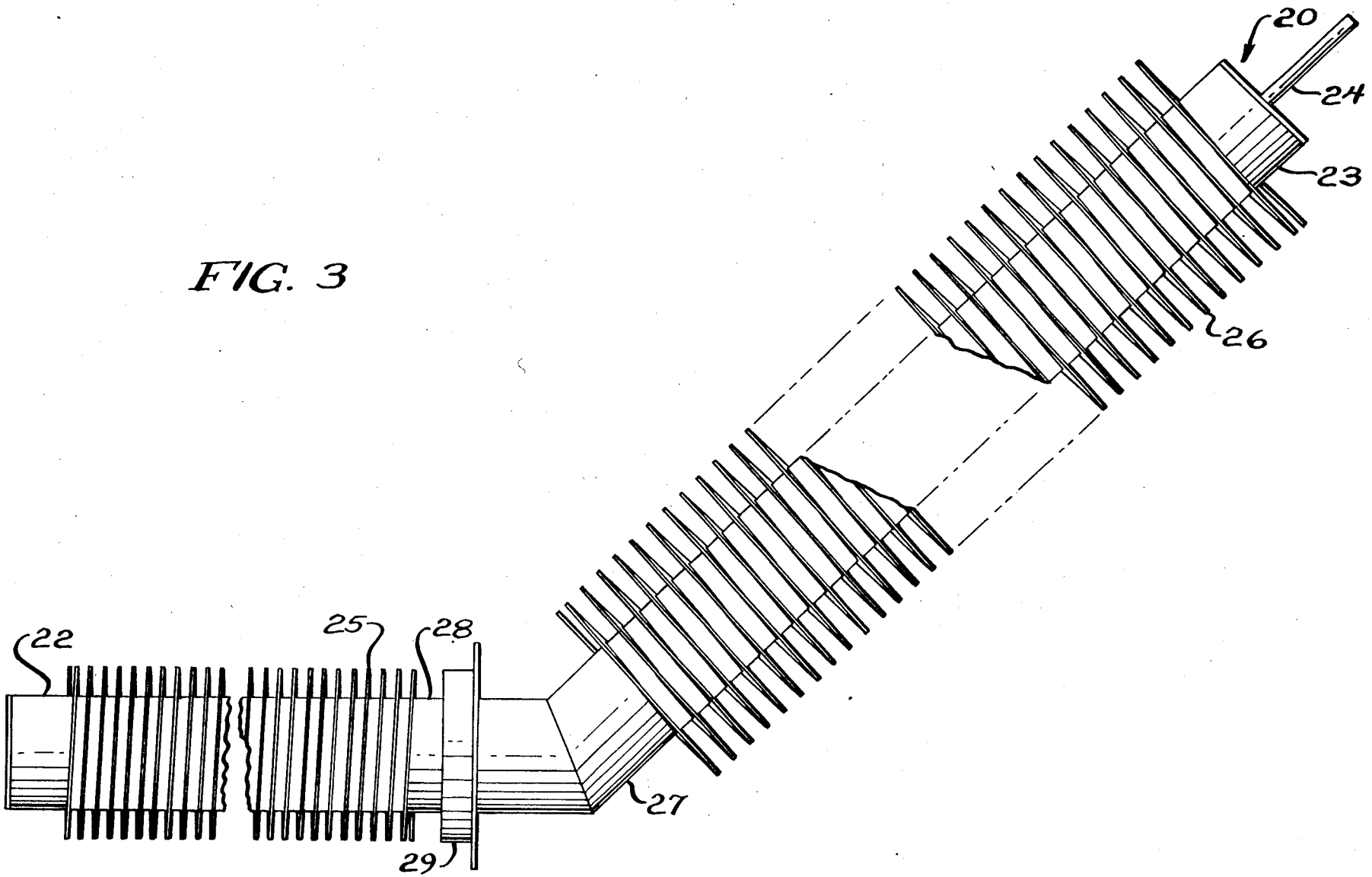
FIG. 3 is a side elevation of a heat pipe utilized in the heat exchange means.

In the illustrative embodiment of the invention as disclosed in FIGS. 1 and 2, a central, forced air furnace generally designated 10 is shown to comprise an enclosure 11 housing a conditioned air blower 12 provided with suitable electric controls 13. A combustible fuel, such as hydrocarbon gas, is provided to the furnace through a gas line 14 through a conventional gas valve 15. The furnace includes a heat exchange chamber generally designated 9 having a heat input portion or combustion chamber enclosure 19 and a heat output portion 42.

The combustible gas is mixed with air and the gas-air mixture is delivered by means of a combustion blower 16 through a transfer pipe 17 to an inlet portion 18 of the combustion chamber enclosure 19. The combustion products are passed in heat exchange relationship with a plurality of heat pipes 20 and discharged from the furnace through a conventional vent pipe 21.

Each heat pipe 20, as illustrated in FIG. 3, comprises a sealingly closed tube having a first, evaporator portion 22 and a second, condenser portion 23 extending at an angle such as 45° to the evaporator portion. The heat pipe is filled through a sealable filling pipe 24 with a suitable condensable heat transfer fluid which, in the illustrated embodiment, comprises distilled and deaerated water with 5% sodium chromate dissolved therein. The heat pipe is formed of stainless steel, such as 304 or 316 stainless steel.

In the illustrated embodiment, the evaporator comprises a 1" diameter stainless steel tube having a wall thickness of 0.049", with a helical fin 25 concentrically carried thereon having a 1½" outer diameter and approximately 8 turns per inch. Condenser 23 comprises a 1" diameter stainless steel tube having a 0.049" wall thickness and a helical fin 26 having a 2" outer diameter and 5 turns per inch. In the illustrated embodiment, the condenser tube is 15" long. The evaporator fin 25 is preferably formed of stainless steel, whereas the condenser fin is preferably formed of aluminum. The fins are preferably tension-mounted or embedded in the stainless tube outer surface for good thermal contact and, additionally, may be brazed to the tubes for further improved thermal transfer.

Prior to filling the heat pipe with the condensable fluid, it is evacuated to approximately 60 microns vacuum pressure.

The provision of the sodium chromate effectively minimizes internal corrosion and internal gas generation, which otherwise can reduce thermal transfer efficiency, and provides increased protection under temperatures of approximately −25° F.

The use of stainless steel fins on the evaporator tube 22 reduces the heat transfer rate so as to avoid vapor lock at startup by providing an effective thermal dampening of the system. Further, the stainless steel tube and fin arrangement of the evaporator provides for improved corrosion resistance to the products of combustion in the operation of the furnace.

The angled heat pipe arrangement provides for versatility in the application of the heat pipes in the furnace heat transfer structure.

In the illustrated embodiment, end 27 of the condenser portion 23 is connected to end 28 of evaporator portion 22 by means of a stainless steel mounting collar 29.

Figure 6:
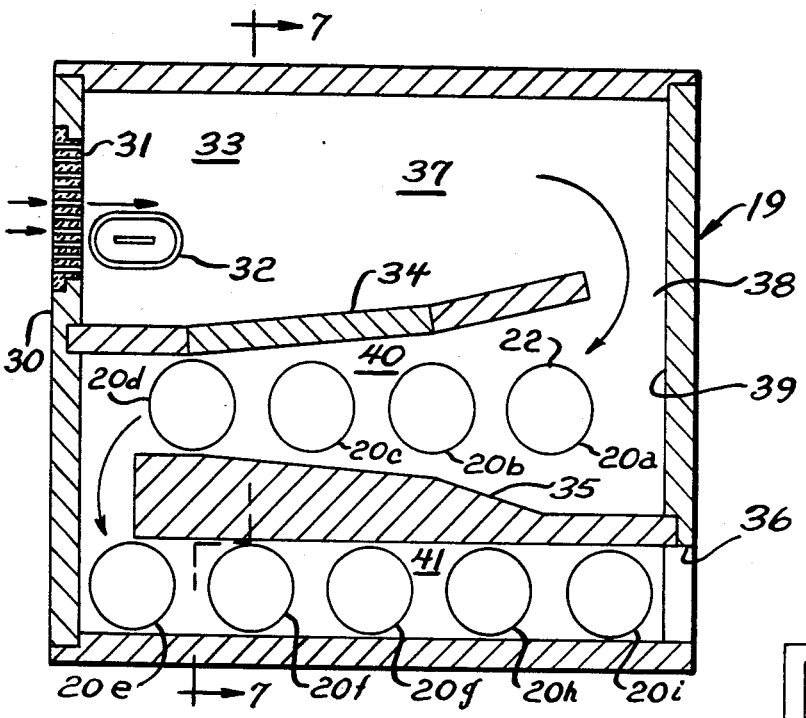
FIG. 6 is a vertical section of the heat transfer chamber embodying the invention.
Figure 5:
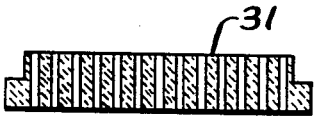
FIG. 5 is a transverse section taken substantially along the line 5—5 of FIG. 4.
Figure 4:
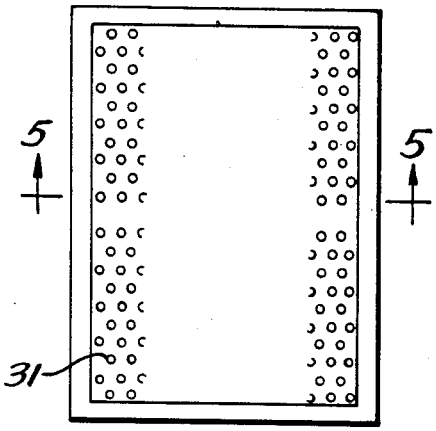
FIG. 4 is an elevation of the burner of the furnace.

Referring now to FIG. 6, the combustion chamber enclosure 19 includes a wall portion 30 provided with a ceramic burner grid 31. A silicone carbide igniter 32 is disposed within a combustion chamber 33 for igniting the premixed air and gas delivered from blower 16.

As seen in FIGS. 6 and 7, the interior of the enclosure 19 is subdivided by a pair of insulative baffle walls 34 and 35. The enclosure further defines an outlet 36. The products of combustion formed in combustion chamber portion 33 pass through an acoustic decoupling chamber portion 37 before entering an inlet portion 38 of an input heat transfer chamber 39 separated from the combustion chamber portion 33 and acoustic decoupling chamber portion 37 by the baffle wall 34.

The heat transfer chamber includes a first portion generally designated 40 having a transverse cross section which decreases in area in a direction away from the input heat source means 31,33,37,38. The input heat transfer chamber 39 further defines a second, final portion generally designated 41 having a transverse cross section which is substantially constant in area in the direction away from the input heat source means.

In the illustrated embodiment, nine heat pipes are provided in the input transfer chamber 39, including heat pipes 20*a*, 20*b*, 20*c*, and 20*d* in transfer chamber portion 40, and heat pipes 20*e*, 20*f*, 20*g*, 20*h* and 20*i* in heat transfer chamber portion 41. As shown in FIG. 6, the insulative baffle wall 35 effectively separates the portions 40 and 41 of the input heat transfer chamber, the heat pipes being arranged in effectively folded series relationship extending serially through the chamber portions 40 and 41.

In the illustrated arrangement, each relatively downstream pipe is dependent on the performance of the pipes upstream of it for the downstream pipe to see normal loading conditions. The novel baffle wall arrangement defines loading means for uniformly loading the heat pipes in heat transfer chamber portion 40 as an incident of transferring heat from the input heat source means through the evaporator portion and condenser portion of each of the heat pipes to the fluid to be heated in the output heat exchange chamber portion 42. As seen in FIG. 2, the conditioned air blower 12 delivers the air to be heated through the output heat exchange portion 42 in heat transfer association with the condenser portions 23 of the heat pipes 20. It has been found that the heat pipes define extremely efficient heat exchanger means so as to be capable of providing an overall furnace operating efficiency in excess of 85% in the illustrated embodiment. Additionally, the transfer means permits the furnace to be of highly compact construction and readily adapted for different types of air flow, including upflow, downflow, and horizontal flow.

In operation, the air-gas mixture is ignited at the ceramic burner 31 by means of the silicone carbide igniter 32 so as to provide high temperature products of combustion through the input heat transfer chamber portions 40 and 41 successively for discharge through the outlet 36 to the vent pipe 21. The novel arrangement of the combustion section of the combustion chamber enclosure 19 provides beneficial acoustic decoupling of the ceramic burner and the input heat chamber portion 39. It appears that the acoustic decoupling is effected by means of the reversing of the flow of the products of combustion from the acoustic decoupling chamber portion 37 to the input heat transfer chamber portion 40 through the transfer passage 38. Thus, by dividing the enclosure 19 by means of baffle wall 34 into a combustion section and a heat transfer section, combustion resonance control is obtained in addition to uniform loading of the heat pipe evaporator portions in heat transfer chamber portion 40.

It is desirable to maintain uniform evaporator tube loading to obtain optimum heat transfer. It has been found that with the provision of the decreasing cross section of the input heat transfer chamber portion 40 with the series heat pipe arrangement disclosed, heat pipes 20*a*, 20*b*, 20*c* and 20*d* operate at or near the design load of approximately 8,000 to 10,000 BTU's per hour. This is substantially lower than the maximum heat transfer rate of the heat pipes which illustratively may be approximately 14,000 BTU's per hour. The heat transfer pipes 20*e*, 20*f*, 20*g*, 20*h* and 20*i* are subjected to substantially lower product of combustion temperature and it has been found that the use of the constant cross section of input heat transfer chamber portion 41 subjects these pipes to decreasing heat transfer loading and these heat pipes operate at a level lower than the design range. Thus, a margin of safety is provided in case of tube failure of any of the tubes in chamber portion 40 which, because of the subjection thereof to the higher temperature flue gases, are more susceptible to tube failure.

As indicated briefly above, by use of the stainless steel fin 25 on the evaporator heat pipe portion 22 and the use of the stainless steel pipe construction, the thermal response of the heat pipe is decreased, permitting the heat input source to be operated immediately at full design rate. The reduced heat transfer coefficient reduces the amount of heat entering the pipe so that the heat pipe operation may start in a normal manner notwithstanding the subjection of the heat pipes to high temperature at this time.

When the heat pipe reaches the design temperature, heat rejection through the condenser portion is initiated at a rate that is calculated to hold the design temperature of the heat pipe. While the invention is disclosed in conjunction with heat pipes utilizing heat transfer fins, it will be obvious to those skilled in the art that the invention may be applied to heat pipes without such fins.

Figure 8:
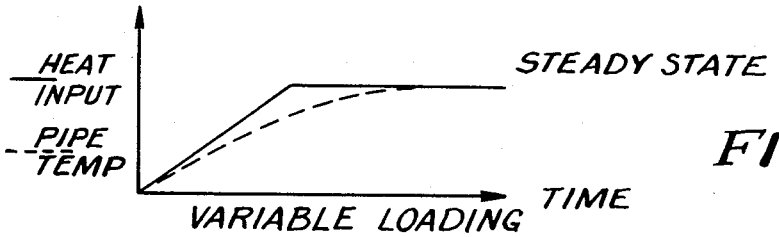
FIG. 8 is a graph illustrating the heat input and the temperature of the heat pipe as a function of time.
Figure 9:
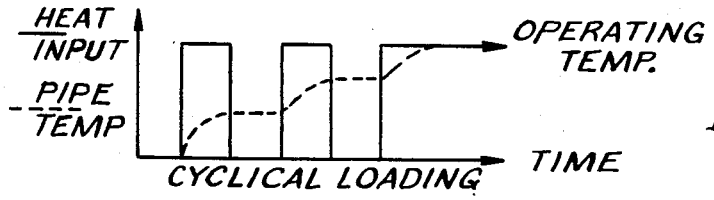
FIG. 9 is a graph similar to that of FIG. 8 illustrating a modified method of operation wherein the heat input is cycled.
Figure 10:
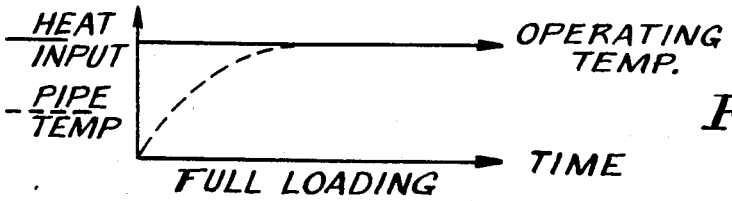
FIG. 10 is a graph similar to that of FIG. 8 but illustrating a further modified method of operation wherein the burner is energized initially at full steady state operation.

Different methods of loading the heat pipes by varying the combustion characteristics within combustion chamber 33 under the control of electric control 13 are illustrated in FIGS. 8, 9 and 10. The loading of the heat pipe by maintaining the heat input at the normal full input in conjunction with the low thermal transfer evaporator portion means discussed above to bring the heat pipes to operating temperature is illustrated in FIG. 10. As shown in FIG. 8, variable loading may be effected by utilizing heat pipes of high thermal transfer characteristics, with corresponding gradual increase in the amount of heat delivered to the heat pipes from the burner 31 until the steady state operating temperature of the pipes is reached.

As illustrated in FIG. 9, a further alternative method of loading the heat pipes may comprise operating the burner at full capacity at spaced time intervals until the operating temperature of the heat pipe is reached.

As indicated above, the heat transfer rate may be controlled by the rate of delivery of the air to be conditioned in thermal transfer association with the condenser portions of the heat pipes. The invention comprehends that both the heat input rate and the heat output rate may be adjusted continuously or independently to the design heat pipe loading rate while maintaining the temperature at the design temperature.

The foregoing disclosure of specific embodiments is illustrative of the broad inventive concepts comprehended by the invention.

I claim:

1. In a furnace having input heat source means, means defining a heat exchange chamber having heat input and heat output portions, said heat input exchange portion including an input heat transfer chamber, and means for conducting a fluid to be heated through said heat exchange output portion of the heat exchange chamber for transfer of heat to said fluid, the improvement comprising:

a plurality of heat pipes each having an evaporator portion, a condenser portion, and a condensable heat transfer fluid therein, at least a given number of said evaporator portions being arrranged to serially receive heat from said input heat source means in said heat transfer chamber; and means for uniformly loading said given number of said serially heated heat pipes in said heat input portion as an incident of transferring said heat from the input heat source means through said evaporator portions and condenser portions of said heat pipes to said fluid to be heated in said heat exchange chamber output portion.

2. The surface structure of claim 1 wherein said furnace defines a combustion chamber separate from said heat transfer chamber for conducting heat combustion products to said heat transfer chamber to flow therethrough in heat transfer association with the evaporator portions of said heat pipes.

3. The furnace structure of claim 1 wherein all of said heat pipe evaporator portions are arranged to serially receive said heat from said input heat source means.

4. The furnace structure of claim 1 wherein said heat pipes are arranged in first and second discrete groups, said loading means causing uniform loading of said first group, heat transfer through said second of said groups substantially below the maximum rate at which the heat pipes thereof are disposed to operate.

5. The furnace structure of claim 1 wherein said heat pipes are arranged in discrete groups, said loading means causing heat transfer through only one of said groups substantially below the maximum rate at which the heat pipes thereof are disposed to operate, all of said heat pipes comprising heat pipes designed to be operated at substantially the same maximum heat transfer rate.

6. The furnace structure of claim 1 wherein said heat pipes are arranged in discrete groups, said loading means causing heat transfer through only one of said groups substantially below the maximum rate at which the heat pipes thereof are disposed to operate, all of said heat pipes comprising heat pipes designed to be operated at substantially the same maximum heat transfer rate of approximately 14,000 BTU/hr.

7. The furnace structure of claim 1 wherein said all of said heat pipe evaporator portions are spaced in a series extending in the direction of flow of fluid from said heat source means.

8. The furnace structure of claim 1 wherein said heat input heat transfer chamber includes a first portion having a transverse cross section which decreases in area in a direction away from said input heat source means.

9. The furnace structure of claim 1 wherein said heat input portion of the heat transfer chamber includes a final portion having a transverse cross section which is constant in area in a direction away from said input heat source means.

10. In a furnace having input heat source means, means defining a heat exchange chamber having heat input and heat output portions, said heat exchange chamber input portion including a heat transfer chamber, and means for conducting a fluid to be heated through said heat exchange output portion of the heat exchange chamber for transfer of heat to said fluid, the improvement comprising:

a plurality of heat pipes each having an evaporator portion and a condenser portion, and a condensable heat transfer fluid therein, said input heat transfer chamber defining a flow path having an outlet and defining means for conducting hot fluid provided from said input heat source means to said outlet; and means for disposing the evaporator portions of said heat pipes in a series extending longitudinally of said flow path for successive heat transfer association of said fluid heated by said heat source with the condensable heat transfer fluid in the respective heat pipes, and with the condensing portion thereof disposed in said output heat exchange chamber portion for transferring heat from said condensable heat transfer fluid to the fluid to be heated, said flow path means defining a first portion decreasing in transverse area in the direction of flow of the hot fluid therethrough to uniformly load the heat pipes in said first portion.

11. The furnace structure of claim 10 wherein said heat pipe evaporator portions are arranged in successive groups.

12. The furnace structure of claim 10 wherein said heat pipe evaporator portions are arranged in successive groups, said flow path means defining a second portion having flow restricting characteristics different from that of said first portion.

13. The furnace structure of claim 10 wherein said heat pipe evaporator portions are arranged in successive groups, said flow path means defining a second portion having flow restricting characteristics different from that of said first portion, said portions corresponding to said groups.

14. The furnace structure of claim 1 wherein said input heat transfer chamber has variable flow restricting characteristics longitudinally thereof.

15. The furnace structure of claim 10 wherein said first flow path portion has increasing flow restricting characteristics longitudinally thereof away from said heat source means.

16. The furnace structure of claim 11 wherein said second flow path portion has constant flow restricting characteristics longitudinally thereof.

17. The furnace structure of claim 10 wherein said heat pipe evaporator portions are arranged in successive groups, said groups defining a folded series.

18. The furnace structure of claim 10 wherein the downstreammost heat pipe input portion is disposed adjacent said flow path outlet.

19. In a furnace having a burner means for producing hot products of combustion, and heat transfer means defining a flow chamber for conducting the hot products of combustion for heat transfer association with heatable output means, the improvement comprising said flow chamber means having a preselected narrowing cross-sectional configuration aligned with said burner means to define acoustic decoupling means for preventing resonating of the products of combustion in said flow chamber.

20. The furnace of claim 19 wherein said heat exchanger means includes a row of heat exchanger tubes, and said acoustic decoupling means comprises means for disposing said burner means in disalignment with said row.

21. The furnace of claim 19 wherein said heat exchanger means includes a row of heat exchanger tubes, and said acoustic decoupling means comprises means for disposing said burner means in disalignment with said row, including means defining a combustion chamber in which said burner means is disposed, and means defining a transfer passage between said combustion chamber and said flow chamber opening substantially perpendicularly to said flow chamber.

22. The furnace of claim 19 wherein said heat exchanger means includes a row of heat exchanger tubes, and said acoustic decoupling means comprises means for disposing said burner means in disalignment with said row, including means defining a combustion chamber in which said burner means is disposed, and means defining a transfer passage between said combustion chamber and said flow chamber opening substantially perpendicularly to said flow chamber at one end of said row of heat exchanger tubes.

23. The furnace of claim 19 wherein said heat exchanger means includes a row of heat exchanger tubes, and said acoustic decoupling means comprises means for disposing said burner means in disalignment with said row, including means defining a combustion chamber in which said burner means is disposed, and means defining a transfer passage between said combustion chamber and said flow chamber opening substantially perpendicularly to said flow chamber at one end of said row of heat exchanger tubes, said burner means being disposed in said combustion chamber remotely from said transfer passage.

24. The furnace of claim 19 wherein said heat exchanger means includes a row of heat exchanger tubes, and said acoustic decoupling means comprises means for disposing said burner means in disalignment with said row, including means defining a combustion chamber in which said burner means is disposed, and means defining a transfer passage between said combustion chamber and said flow chamber at one end of said row of heat exchanger tubes, said burner means disposed in said combustion chamber remotely from said transfer passage, the direction from said burner means to said transfer passage being substantially opposite the direction of flow of the products of combustion from said transfer passage through said flow chamber.

* * * * *